United States Patent [19]

Grandine et al.

[11] 3,935,646

[45] Feb. 3, 1976

[54] GEL ELECTROPHORESIS SLIDE DRYING

[75] Inventors: Joseph D. Grandine, Acton; James E. Snyder, Brighton, both of Mass.

[73] Assignee: Millipore Corporation, Bedford, Mass.

[22] Filed: Nov. 15, 1974

[21] Appl. No.: 524,364

[52] U.S. Cl. ..... 34/92; 34/15; 432/205

[51] Int. Cl.[2] ..... F26B 19/00

[58] Field of Search ..... 34/15, 92; 432/205

[56] References Cited

UNITED STATES PATENTS

| | | | |
|---|---|---|---|
| 3,135,589 | 6/1964 | Stokes | 34/92 X |
| 3,253,351 | 5/1966 | Bettanin | 34/92 |
| 3,284,917 | 11/1966 | Foote | 34/15 |
| 3,773,054 | 11/1973 | Clark | 34/92 |

*Primary Examiner*—John J. Camby

*Attorney, Agent, or Firm*—Kenway & Jenney

[57] ABSTRACT

Apparatus for rapidly and conveniently drying an agarose gel slide following electrophoresis is provided which utilizes both vacuum and heated air to remove moisture from the slide.

6 Claims, 5 Drawing Figures

GEL ELECTROPHORESIS SLIDE DRYING

FIELD OF THE INVENTION

This invention relates in general to electrophoresis and more particularly to an apparatus for drying electrophoresis slides after a separation has occurred and the proteins so separated have been fixed.

BACKGROUND OF THE INVENTION

Electrophoresis is a method for the analysis of proteins in body fluids and has proven to be very valuable in laboratory and clinical work. There have been a number of commercial instruments produced for relatively low resolution applications, in which the electrophoretic medium is a microporous plastic membrane or filter paper which permits resolution of perhaps five components in the material being analyzed. Much higher resolution and accordingly analysis of as many as fifteen components may be obtained utilizing a relatively large area of agarose gel slide which is subjected to electrophoresis under specific contolled conditions. Such a slide is formed of an aragose gel with a barbital buffer added. While measurements performed with these slides have shown excellent results in laboratory environments, in order to attain widespread clinical use, an apparatus for providing easy, economical and particularly accurate and reproducible results is required.

In electrophoresis, the initial step is to apply the sample material to the electrophorteic medium and allow the separation to take place by migration under the influence of an applied electric field. Thereafter the slide is fixed chemically, dried and subsequently read either directly or with appropriate densitometer devices. To obtain a practical migration apparatus, the device must be capable of obtaining accurate and highly reproducible results even when operated by relatively unskilled technicians. As above indicated, once the electrophoretic migration has taken place, the slide must be fixed, dried and stained to provide for interpretation and to provide a permanent record. The fixing is done with appropriate chemical baths in accordacne with standard techniques. Once the fixing has been completed, the slide must be dried prior to staining to enhance the contrast between the protein molecules and the background. One technique for drying the slide is to press the slide under absorbing pads with a weight of perhaps 1 kilogram to force excess liquid from the slide into the absorbing pad and thereafter to complete the drying process with an air dryer. This drying process takes about two hours. It will be appreciated that this process is awkward and difficult to use in service laboratories where routine electrophoresis testing is to be carried out both accurately and economically for a large number of samples.

It is therefore the primary object of the present invention to provide a drying station for electrophoresis slides, which will permit accurate, routine and economical drying of slides prior to staining and densitometer readout.

SUMMARY OF THE INVENTION

In the present invention an apparatus is provided in which an electrophoretic slide may be readily and conventionally mounted first for applying a vacuum to the slide to remove moisture rapidly and reduce the slide to a substantially less moist condition and thereafter, in the same apparatus, to provide for drying with heated air by flowing the heated air directly onto the active surface of the slide. The apparatus is constructed to minimize handling and to perform both operations at the same location. Such an arrangement provides, not only for routine and accurate handling of the slide with ease, but the time required for complete drying is of the order of a few minutes. The drying process includes two steps, vacuum drying followed by hot air drying. Apparatus made in accordance with the invention includes a housing having both vacuum connections and a source of heated air. The housing is formed to receive a vacuum tray subassembly in which the electrophoresis slide is mounted during the initial step and a slide retainer in which the same slide can be exposed to the heated air during the second step of the drying process.

DESCRIPTION OF PREFERRED EMBODIMENTS

Figure 1:
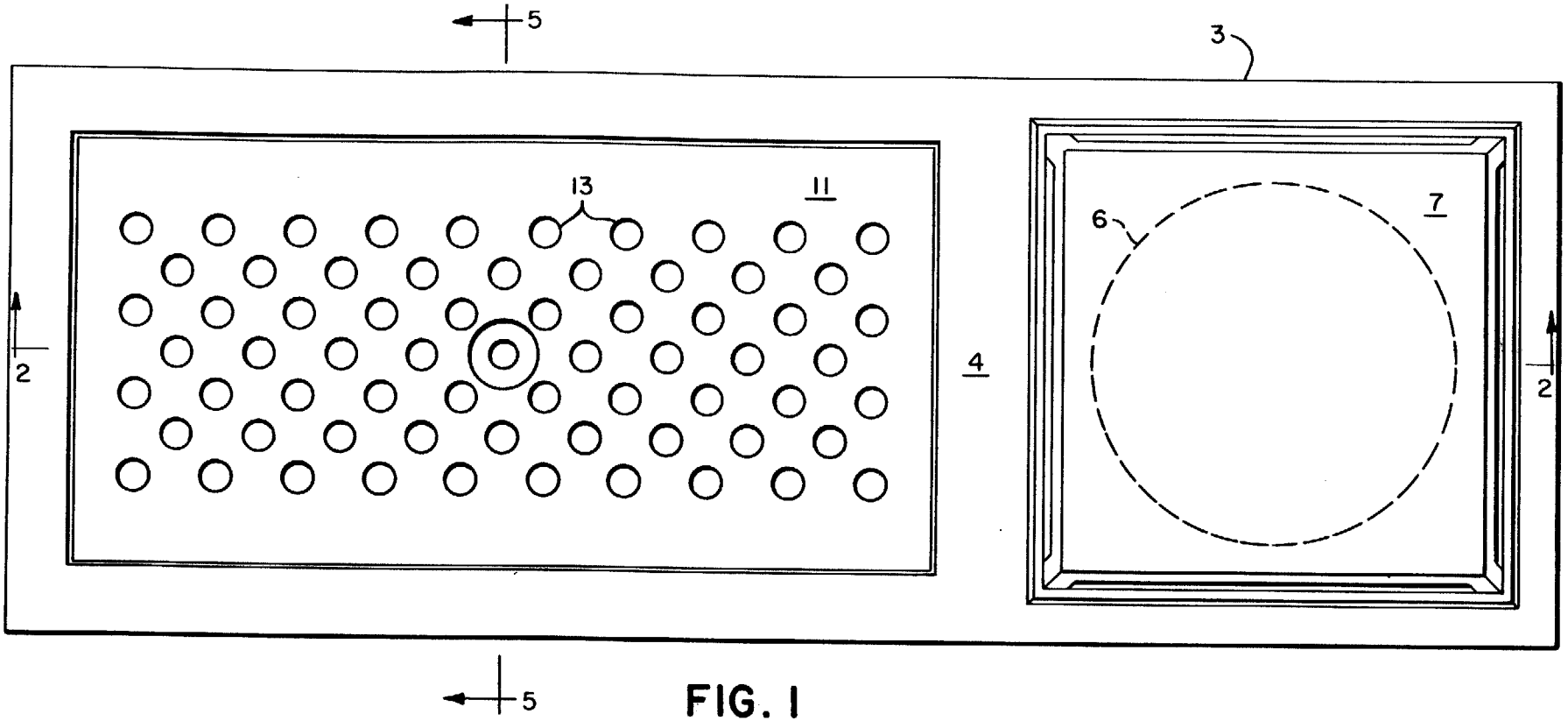
FIG. 1 is an illustration in plan view of an electrophoresis slide drying apparatus constructed in accordance with the principles of this invention.
Figure 2:
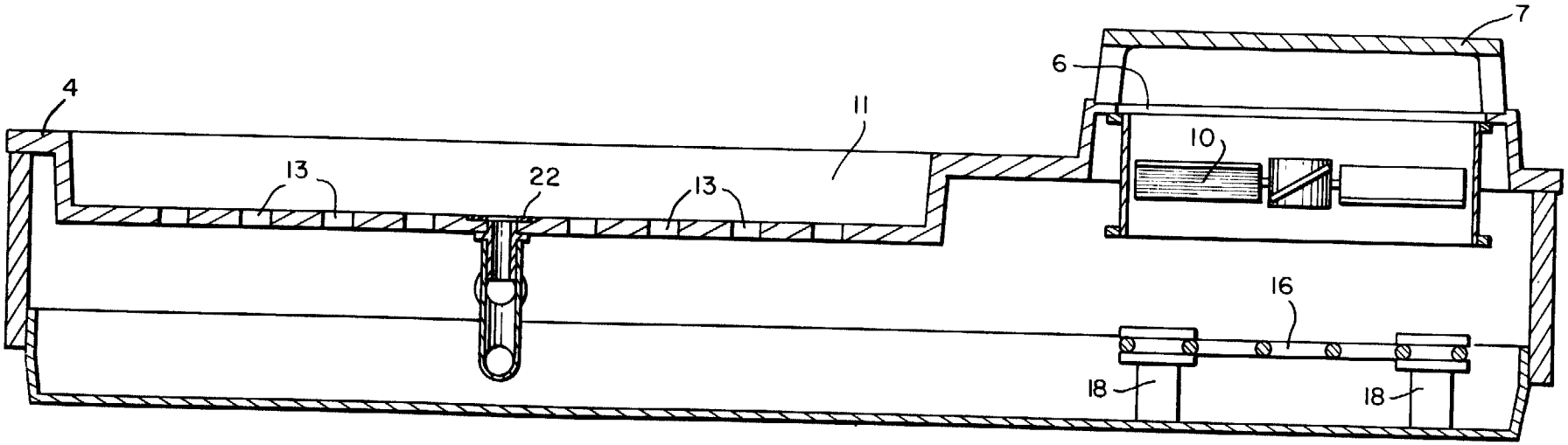
FIG. 2 is a cross sectional view of the apparatus of FIG. 1 taken along the line 2—2 of FIG. 1.

The drying station, as is depicted in FIGS. 1 and 2, includes a generally rectangular housing 3 with a cast aluminum member 4 serving as the housing cover. The housing cover 4 has a generally circular opening 6 over which is supported an open sided fan cover plate 7. An air fan 10 is positioned below opening 6 to draw air into the housing 3 over a heating coil 16 supported on insulating standoffs 18. The housing cover member 4 includes a rectangular depression generally indicated at 11 which receives both the vacuum drying subassembly and a slide retainer subassembly for retaining the electrophoresis slide when it is to be exposed to a flow of heated air. Operationally, before drying the electrophoresis slide is fixed and rinsed, and the gel therefore contains liquid. This must be removed prior to staining and densitometer measurements.

In the present invention the fluid removal is a two step process. In the first step a vacuum is applied to the agarose gel surface of the slide and in three or five minutes a very high proportion, for example 80 to 90%, of the fluid content of the gel is removed. Upon completion of this step, the slide is exposed to a flow of heated air to remove the remainder of the moisture content. Both the vacuum subassembly and the slide retaining element for use in exposing the slide to the flow of heated air, are arranged to fit within the rectangular depression 11 in which the circular openings 13 provide for the flow of heated air against the surface of the slide with the slide retaining element in position and, in which the vacuum connection provides for applying the vacuum to the slide when it is included within the vacuum subassembly.

Figure 3:
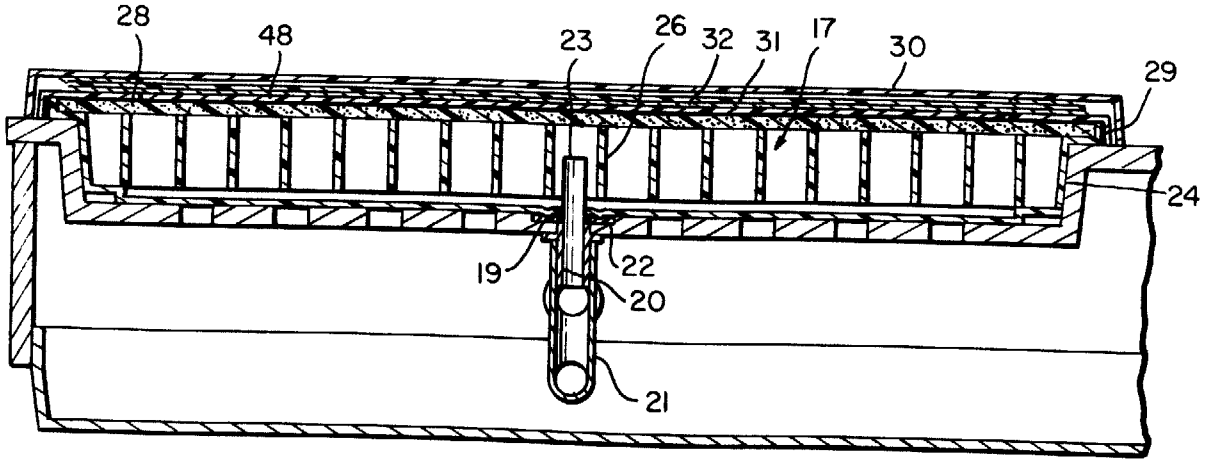
FIG. 3 illustrates a portion of the cross sectional view of FIG. 2 with a vacuum subassembly in position.

In FIG. 3, the vacuum subassembly generally indicated at 17 is shown positioned on the housing 3. This subassembly includes a generally rectangular vacuum tray 24 formed typically of molded plastic with a ribbed support member 26 positioned within the tray 24 and supporting on its upper surface a sintered polyethylene sheet 28, which provides for a planar support surface for the electrophoresis slide 48. The polyethylene sheet 28 is fastened to the tray 24 by means of a slide locating frame 29 which is sealed to the tray body and provides a rectangular frame for locating the slide on the porous surface of sheet 28. The vacuum tray 24 includes a standpipe 23 which is fastened over a vacuum connection 20 which is typically press fit into the bottom of the tray 24 and which provides a connection for evacuating the tray to remove the water from the gel surface of the electrophoresis slide. A seal is formed between an annular lip 19 on the bottom of tray 24 and a gasket 22 on base member 4. The gasket may be formed of 1/16" silicone rubber for example. The vacuum tube 21 within the housing 3 may be connected to a suitable external vacuum pump (not shown).

The sintered polyethylene sheet 28 is typically 3/16 inch thick and has a porosity of approximately 70%. A cover member 30 for providing a vacuum seal to the vacuum subassembly 17 is formed of a plastic material and includes a sponge elastomer pad 32 formed of a material such as closed cell rubber, which is fastened to the cover 30 at its periphery by means of a backing plate 31 so that, when the cover is positioned over an elastophoresis slide, the application of a vacuum to the subassembly will draw the resilient sponge rubber pad 32 against the surface of the substrate electrophoresis slide 48 and, since the slide is supported by the sintered polyethylene sheet 28, a substantially uniform pressure is provided over the entire surface of the slide to remove the fluid from it. It is important to note that the rubber pad must be free to move downwardly against the slide. It should not be secured, except at its edges, to the cover 30. The ribbed support member 26 provides for relatively uniform support for the polyethylene sheet 28 and allows the removed moisture to drain into the vacuum tray 24 itself. The entire vacuum drying operation may be carried out in one or two minutes.

Figure 4:
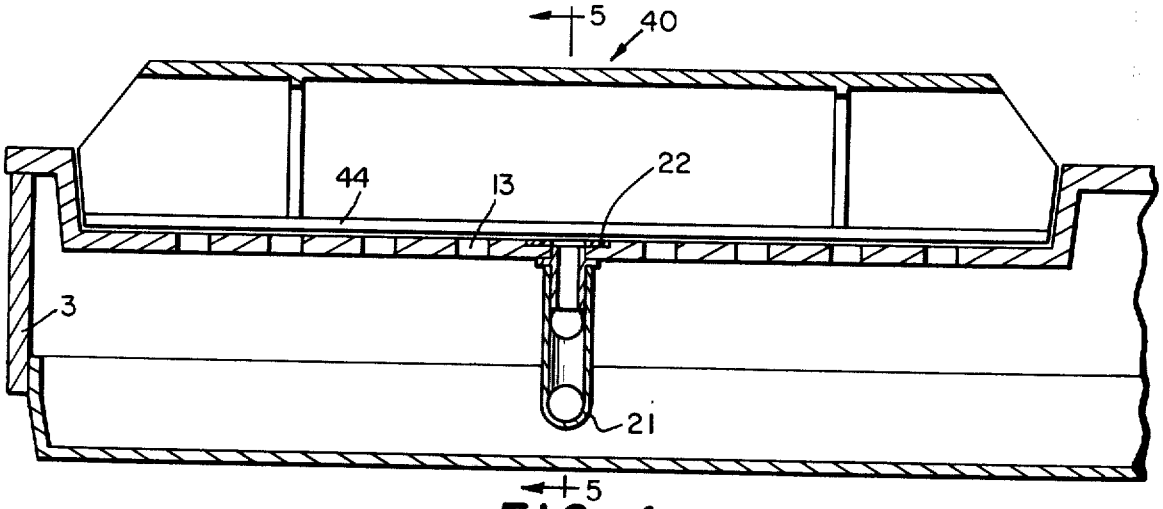
FIG. 4 illustrates a portion of the view of FIG. 2 with a slide retainer subassembly in position.
Figure 5:
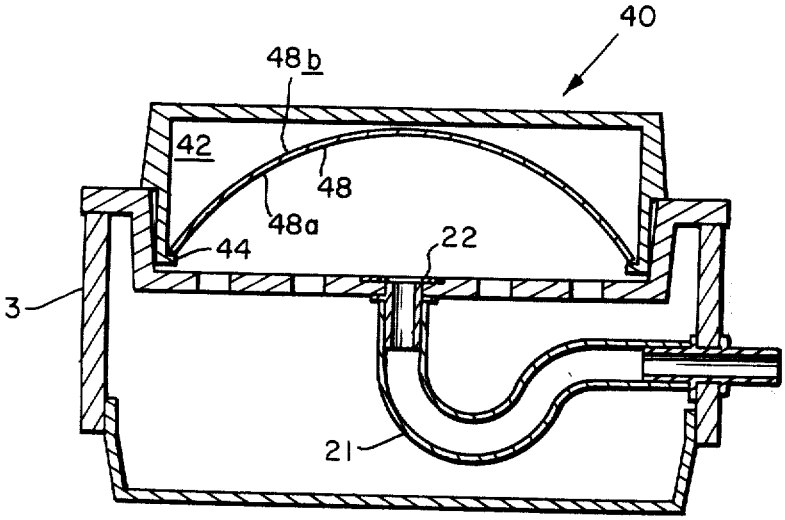
FIG. 5 is a cross sectional view along the line 5—5 of FIG. 1 but having the slide retainer subassembly in position.

In FIGS. 4 and 5 the slide retaining element 40 is shown in place on the housing 3. The slide retaining element 40 is formed of a generally rectangular inverted tray having a pair of ribbed members 42 curved to receive the electrophoresis slide 48. The slide 48 is mounted within the retaining element 40 with the agarose gel surface 48a facing the open portion of the tray 40 and snapped into a curved position within projecting lip 44. The overall retainer 40 is then positioned, as shown, in depression 11 in the housing 4. The fan 10 blowing air over the heating coil 16 creates a flow of heated air which passes through the circular openings 13 in the base member 4 and impinges directly onto the agarose gel surface **48*a* of the slide 48**. As a second step following the vacuum step, an additional minute or two of exposure of slide to the heated air is sufficient to dry the surface.

With the apparatus as shown, a single apparatus may be used for the drying of agarose gel slides and yet, with the application of a two step process of vacuum drying plus heated air drying, the required drying time for the slide may be reduced from approximately one to two hours to 2 to 4 minutes.

We claim:

1. Apparatus for drying a gel electrophoresis slide comprising, a housing having a generally rectangular recess therein, connection means within said recess providing a conduit connecting to a vacuum producing means, means for generating a flow of heated air within said housing, said housing including a plurality of openings within said rectangular recess permitting said heated air to flow therethrough, first and second subassemblies for holding an electrophoresis slide during a two-step drying process, each of said subassemblies being formed to fit, one at a time, within said housing recess, said first subassembly including a tray having one open side, a planar porous surface slide support means, a ribbed support member in said tray supporting a planar porous surface in spaced apart parallel relation to the side of said tray opposite said open side and coextensive with said open side, for mounting the electrophoresis slide to be dried, and a cover member for said tray, said cover member including a resilient surface pad forming a substantially vacuum tight seal with said tray, said tray having a connection therein for coupling to said vacuum connection within said housing.

2. Apparatus in accordance with claim 1 wherein in said first subassembly the planar slide support surface is formed of sintered polyethylene.

3. Apparatus for drying a gel electrophoresis slide comprising, a housing having a generally rectangular recessed portion, said housing having a vacuum connection in said housing recess, a subassembly, said subassembly including a generally rectangular tray having one open side therein, a ribbed support member in said tray supporting a planar porous surface in spaced apart parallel relation to the side of said tray opposite said open side and coextensive with said open side, for mounting the electrophoresis slide to be dried, and a cover member for said tray, said cover member including a resilient surface pad forming a substantially vacuum tight seal with said tray, said tray having a connection therein for coupling to said vacuum connection within said housing.

4. An apparatus in accordannce with claim 3 in which said planar support surface is formed of a sintered polyethylene sheet.

5. An apparatus in accordance with claim 3 wherein said cover has retained within it a flexible elastomer sponge sheet to form said resilient surface.

6. Apparatus in accordance with claim 5 said sponge sheet is secured to said cover only at its periphery to allow freedom of said sheet to compress uniformly against a slide supported on said surface member.

* * * * *

UNITED STATES PATENT AND TRADEMARK OFFICE

CERTIFICATE OF CORRECTION

PATENT NO. : 3,935,646

DATED : February 3, 1976

INVENTOR(S) : Joseph D. Grandine and James E. Snyder

It is certified that error appears in the above-identified patent and that said Letters Patent are hereby corrected as shown below:

The title reading:

Gel Electrophoresis Slide Drying should read:

Gel Electrophoresis Slide Drying Apparatus

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*